US006019022A

United States Patent [19]

Dotson

[11] Patent Number: 6,019,022

[45] Date of Patent: Feb. 1, 2000

[54] MULTI-PURPOSE SCREWDRIVER

[75] Inventor: Mark A. Dotson, Watauga, Tenn.

[73] Assignee: Snap-on Tools Company, Kenosha, Wis.

[21] Appl. No.: 09/231,946

[22] Filed: Jan. 15, 1999

Related U.S. Application Data

[60] Provisional application No. 60/078,410, Mar. 18, 1998, and provisional application No. 60/078,893, Mar. 19, 1998.

[51] Int. Cl.[7] ..... B25B 15/00

[52] U.S. Cl. ..... 81/436; 7/165

[58] Field of Search ..... 7/105, 165, 166; 81/436; 30/169

[56] References Cited

U.S. PATENT DOCUMENTS

| | | | |
|---|---|---|---|
| 164,638 | 6/1875 | Cowles . | |
| 180,466 | 8/1876 | Dean . | |
| 196,354 | 10/1877 | Harris . | |
| 224,022 | 2/1880 | Lyman . | |
| 304,520 | 9/1884 | Gable . | |
| 866,931 | 9/1907 | Higgins . | |
| 869,706 | 10/1907 | Hamilton . | |
| 935,459 | 9/1909 | Carr . | |
| 1,423,127 | 7/1922 | Levy . | |
| 2,103,008 | 12/1937 | Kinast . | |
| 2,190,940 | 5/1940 | Frins . | |
| 2,402,994 | 7/1946 | Frantz . | |
| 3,092,411 | 6/1963 | Hardy | 30/169 X |
| 3,816,863 | 6/1974 | Thielemann, Jr. . | |
| 4,530,259 | 7/1985 | Campbell | 30/169 X |
| 4,580,302 | 4/1986 | Barth . | |
| 4,729,271 | 3/1988 | Kenigston . | |
| 4,785,495 | 11/1988 | Dellis . | |
| 4,934,024 | 6/1990 | Sexton, I . | |
| 5,134,008 | 7/1992 | Alm . | |
| 5,210,895 | 5/1993 | Hull et al. . | |
| 5,237,715 | 8/1993 | Bane, III . | |
| 5,259,281 | 11/1993 | Burke . | |
| 5,475,894 | 12/1995 | Wildforster . | |
| 5,546,625 | 8/1996 | Mealey, Sr. . | |
| 5,551,323 | 9/1996 | Beere et al. . | |
| 5,575,030 | 11/1996 | Girard . | |

*Primary Examiner*—James G. Smith
*Attorney, Agent, or Firm*—Emrich & Dithmar

[57] ABSTRACT

A combination screwdriver, scraper and prybar has a handle with an elongated shank terminating in a multi-function blade. The blade has opposed, flat, planar blade faces converging toward and joined by a distal planar end surface which intersects and is perpendicular to the longitudinal axis of the shank. The blade faces are respectfully inclined to the axis at substantially three degrees and substantially seven degrees. The shank may be square or circular in transverse cross-section and, if square, opposed sides of the shank lie in planes perpendicular to the blade faces.

19 Claims, 1 Drawing Sheet

MULTI-PURPOSE SCREWDRIVER

CROSS REFERENCE TO RELATED APPLICATION

This application claims the benefit of U.S. provisional application Ser. No. 60/078,410, filed Mar. 18, 1998 and U.S. provisional application Ser. No. 60/078,893, filed Mar. 19, 1998.

BACKGROUND OF THE INVENTION

The present invention relates generally to hand tools and, in particular, to multi-function tools. The invention has particular application to a driver-type tool, such as a screwdriver, adapted for additional uses.

It is known to provide a variety of different types of generally flat-bladed hand tools for different application purposes, such as screwdrivers, scrapers, prybars and the like. Typically, each such tool has a blade and a shank specifically designed for the particular application for which the tool is intended. Each such tool works well for its intended purpose, but requires that the user maintain a collection of several tools. While multi-function tools have heretofore been provided, their designs have not been optimal for screwdriver scraping and prying applications.

SUMMARY OF THE INVENTION

It is a general object of the invention to provide an improved hand tool which avoids the disadvantages of prior tools while affording additional structural and operating advantages.

An important feature of the invention is the provision of a hand tool which is adapted for multiple uses.

In connection with the foregoing feature, a further feature of the invention is the provision of a driver-type hand tool which is suitable for multiple uses, including driving, prying and scraping.

Still another feature of the invention is the provision of a hand tool of the type set forth, which is of relatively simple and economical construction.

Certain ones of these and other features of the invention are attained by providing a multi-function hand tool comprising: a handle, and an elongated blade coupled to the handle and having a longitudinal axis, said blade having first and second opposed converging planar blade faces respectively disposed on opposite sides of the axis and respectively inclined to the axis at different first and second angles.

The invention consists of certain novel features and a combination of parts hereinafter fully described and illustrated in the accompanying drawings, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 2:
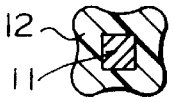
FIG. 2 is a view in vertical section taken along the line 2—2 in FIG. 1.
Figure 4:
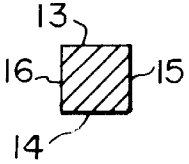
FIG. 4 is a view in vertical section taken along the line 4—4 in FIG. 3.

Referring to FIGS. 1–6 of the drawings, there is illustrated a screwdriver-type hand tool, generally designated by the numeral 10, constructed in accordance with the present invention. The tool 10 has an elongated metal shank 11, which is substantially square in transverse cross-section, fixed at one end to a handle 12, which may be provided with a frictional overgrip sleeve (not shown). The handle 12 is preferably formed of a suitable plastic material, such as cellulose acetate, while the overgrip is formed of a suitable flexible and resilient material, such as rubber. The shank 11 has opposed parallel top and bottom surfaces 13 and 14 and opposed parallel side surfaces 15 and 16.

The shank 11 is provided at its opposite end with a working blade 20, which has a widened portion 21 which is wider than the thickness of the shank 11 and is joined thereto by curved shoulder portions 22. The widened portion 21 has substantially flat, planar, opposed faces 23 and 24 which terminate at a narrow, distal end surface 25, which may be a generally rectangular, planar surface, and which joins the faces 23 and 24 to form a screwdriver tip. More specifically, the face 23 is designed as a scraper face and is inclined at a relatively small angle "a" to the longitudinal axis X of the shank and blade. The face 24 is designed as a prybar face, and is inclined at a larger angle "b" to the axis X.

Figure 6:
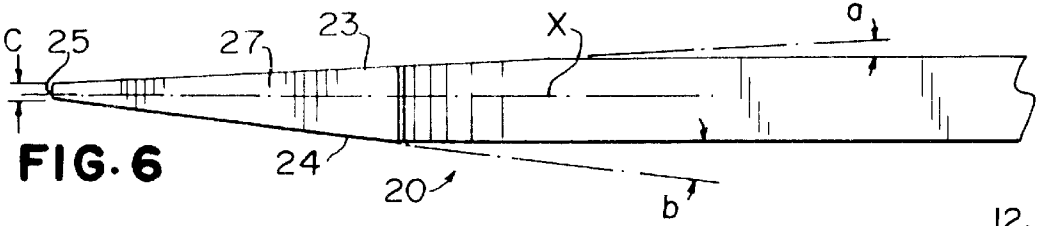
FIG. 6 is a further enlarged, fragmentary view of the blade of the tool of FIG. 1.

It can be seen that the blade faces 23 and 24 are, respectively, disposed on opposite sides of the axis X, and it will be appreciated that the relative lengths of the faces 23 and 24 will depend upon their distances from the axis X at the end surface 25. Thus, if the axis X passes through the center of the end surface 25, the ratio of the lengths of the faces 23 and 24 will be inversely proportional to the ratio a/b. Preferably, the end surface 25 is offset so that it intersects the axis X closer to the face 24 than to the face 23, as illustrated in FIG. 6, so that the lengths of the faces 23 and 24 are more nearly equal.

In formation of the blade 20, the end of the shank 15 is flattened to produce the faces 23 and 24 and then the opposite sides are preferably milled to provide substantially parallel, flat side surfaces 26 and 27, which are respectively substantially parallel to the shank side surfaces 15 and 16 and perpendicular to the blade end surface 25.

In operation, the shallow-angled face 23 is designed to facilitate use of the tool 10 as a scraper and, in use, would typically be disposed downwardly against the surface being scraped. The more steeply inclined face 24 is designed to facilitate use of the tool 10 as a prybar. Also, the widened portion 21 of the blade 20 may be used as a standard flat head screwdriver in the normal manner. If desired, an indicium 28, such as the letter "P", may be imprinted on one side of the shank 11 at the end of the scraper face 23 to indicate that that side is to be disposed upwardly when the tool is used as a prybar. The shank 11 may be provided on the opposite side with an indicium 29, such as the letter "S", to indicate that that side is to be up when the tool is used as a scraper.

The tool 10 has a shank thickness A, a blade end width B, a blade tip thickness C, a shank length D, an exposed shank length E and an overall tool length F. The tool 10 may be provided in a variety of sizes, the dimensions A–F for a number of such sizes being illustrated, by way of example, in Table I.

TABLE I

| Stock | Wide | Thick | Shank Length | Shank Exposed | Total Length |
|---|---|---|---|---|---|
| .250 | .250 | .037 | 7 | 4 | 6 |
| .250 | .312 | .046 | 9 | 6 | 8 |
| .312 | .375 | .060 | 11 | 8 | 11 |
| .375 | .500 | .075 | 11 | 8 | 11 |
| .375 | .625 | .100 | 13 | 10 | 13 |
| A | B | C | D | E | F |

The shank 11 and the handle 12 of the tool 10 are designed to meet the various strength requirements for the several intended uses of the tool. Thus, the handle 12 may be designed to have a tensile strength in the range 3,000–6,000 psi, an elongation at breakage of 50–100% and a compressive strength at yield in the range of 2,000–5,000 psi. The shank 11 is preferably formed of a suitable steel, such as a chrome-vanadium steel, and may be designed to have a tensile strength in the range 90,000–200,000 psi and a yield strength in the range 50,000–200,000 psi. The shank 11 may be suitably heat treated to provide the requisite hardness, while at the same time providing the necessary ductility when the tool is used as a prybar and the necessary strength and wearability when used has a fastener driver or scraper.

Figure 8:
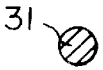
FIG. 8 is a view in vertical section taken along the line 8—8 in FIG. 7.
Figure 1:
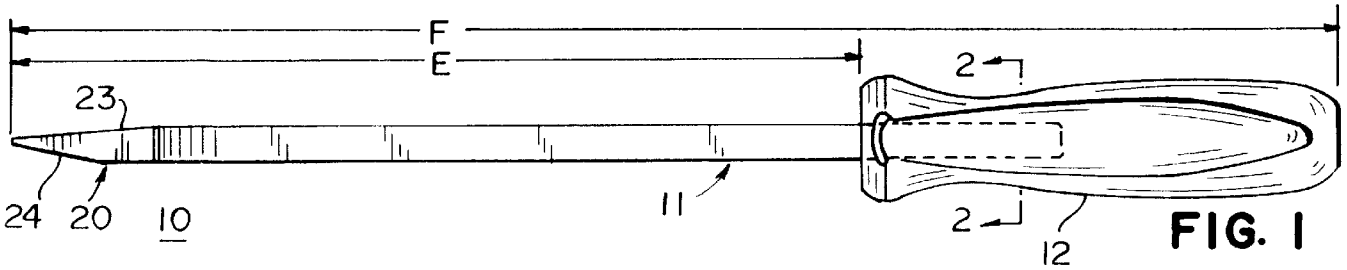
FIG. 1 is a side elevational view of a hand tool constructed in accordance with and embodying the features of the present invention.
Figure 3:
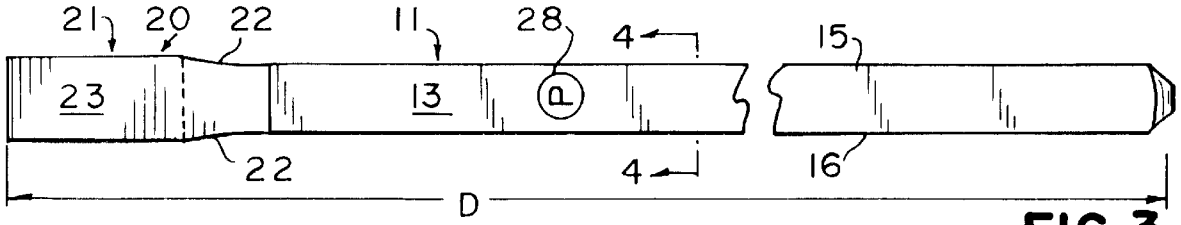
FIG. 3 is an enlarged, fragmentary, top plan view of the shank and blade of the tool of FIG. 1.
Figure 5:
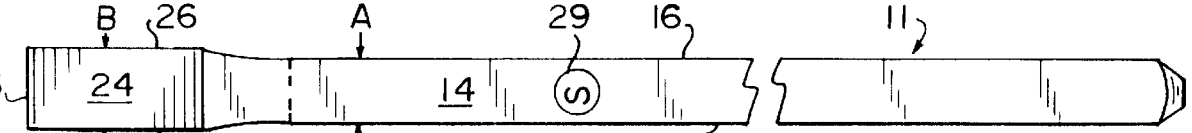
FIG. 5 is a fragmentary, bottom plan view of the shank and blade of FIG. 3.
Figure 7:
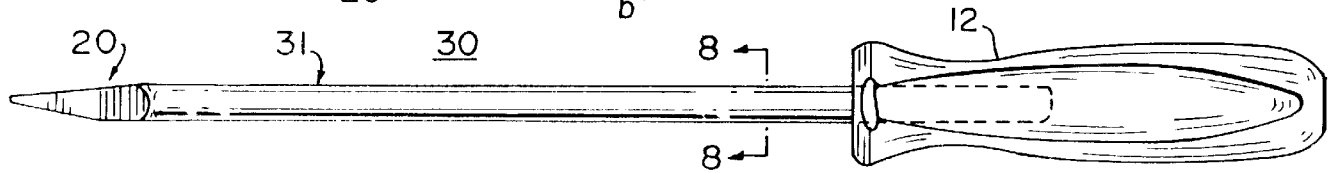
FIG. 7 is a view similar to FIG. 1 of a tool with a circular cross-section shank.

While the shank 11 is preferably formed of square stock to facilitate use as a prybar and to permit the use of a wrench at any point along the shank to apply additional torque, it will be appreciated that other cross-sectional shapes could be utilized. Referring to FIGS. 7 and 8, there is illustrated a hand tool 30 which is substantially the same as the hand tool 10, except that it has a shank 31 which is circular in transverse cross-section. This shape of shank is the simplest and least expensive to manufacture.

While the handle 12 is preferably formed of cellulose acetate, other suitable plastic materials, such as polypropylene materials or PVC could be used and, while the overgrip, if used, is preferably formed of rubber, other materials such as soft polyurethane or the like, could also be utilized.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A multi-function hand tool comprising:

a handle, and an elongated blade coupled to the handle and having a longitudinal axis, said blade having first and second opposed, converging, planar blade faces respectively disposed on opposite sides of the axis and respectively inclined to the axis at different first and second angles, wherein neither of said blade faces intersects the axis.

2. The tool of claim 1, wherein said first and second blade faces respectively have different lengths.

3. The tool of claim 1, and further comprising an elongated shank coupling said blade to the handle.

4. The tool of claim 3, wherein said shank is substantially square in transverse cross section.

5. The tool of claim 4, wherein said shank has opposed side surfaces which respectively lie in planes which are perpendicular to said first and second blade faces.

6. The tool of claim 3, wherein said shank is substantially circular in transverse cross section.

7. The tool of claim 3, and further comprising first and second indicia on said shank adjacent to said blade and respectively designating said first and second blade faces thereof.

8. A multi-function hand tool comprising:

a handle, and an elongated blade coupled to the handle and having a longitudinal axis, said blade having first and second opposed, converging, planar blade faces respectively disposed on opposite sides of the axis and respectively inclined to the axis at different first and second angles, wherein each of said first and second angles is less than 10°.

9. The tool of claim 8, wherein said first angle is less than 5°.

10. The tool of claim 9, wherein said first and second angles are respectively substantially 3° and 7°.

11. A multi-function hand tool comprising:

a handle, and an elongated blade coupled to the handle and having a longitudinal axis, said blade having first and second opposed, converging, planar blade faces respectively disposed on opposite sides of the axis and respectively inclined to the axis at different first and second angles, said blade having a distal end surface intersecting the axis and interconnecting said blade faces.

12. The tool of claim 11, wherein said blade has flat side surfaces perpendicular to said blade faces.

13. The tool of claim 12, wherein said side surfaces are parallel to each other and perpendicular to said end surface.

14. The tool of claim 12, and further comprising an elongated shank coupling said blade to the handle, said side surfaces being spaced apart a distance greater than the thickness of said shank.

15. The tool of claim 14, wherein said side surfaces are respectively joined to said shank by tapered shoulders.

16. The tool of claim 11, wherein said end surface is a substantially flat planar surface disposed substantially perpendicular to the axis.

17. The tool of claim 11, wherein said end surface intersects the axis at a point closer to one of said blade faces than to the other.

18. The tool of claim 11, wherein each of said first and second angles is less than 10°.

19. The tool of claim 18, wherein said first angle is substantially 3° and said second angle is substantially 7°.

* * * * *